US009808064B2

(12) United States Patent
Taylor

(10) Patent No.: US 9,808,064 B2
(45) Date of Patent: Nov. 7, 2017

(54) HEADBAND

(71) Applicant: Bose Corporation, Framingham, MA (US)

(72) Inventor: Tristan Edward Taylor, Bolton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/225,998

(22) Filed: Mar. 26, 2014

(65) Prior Publication Data

US 2015/0272292 A1 Oct. 1, 2015

(51) Int. Cl.
*H04R 5/033* (2006.01)
*A45D 8/00* (2006.01)

(52) U.S. Cl.
CPC ..... *A45D 8/00* (2013.01); *H04R 5/0335* (2013.01); *A45D 2008/002* (2013.01)

(58) Field of Classification Search
CPC ..... H01R 1/10; H01R 1/1008; H01R 1/105; H01R 1/1058; H01R 1/1066; H04M 1/05; H04M 1/6058; H04R 1/10; H04R 1/1008; H04R 1/105; H04R 1/1058; H04R 1/1066; H04R 25/00; H04R 5/033; H04R 5/0335; A45D 8/26; A45D 8/28; A45D 8/36; A63H 33/18
USPC ..... 132/275; 381/378, 379
See application file for complete search history.

(56) References Cited

U.S. PATENT DOCUMENTS 1,650,865 A 11/1927 Edwards
2,237,752 A 4/1941 Clarke
3,272,926 A 9/1966 Falkenberg
3,580,988 A * 5/1971 Orlowski et al. ..... 174/153 G
3,810,525 A * 5/1974 Crenna ..... 181/129
4,039,765 A * 8/1977 Tichy et al. ..... 379/430
4,571,746 A * 2/1986 Gorike ..... 2/209
(Continued)

FOREIGN PATENT DOCUMENTS

DE 3207098 * 11/1982
DE 19711708 A1 10/1998
WO 2013/099417 A1 7/2013

OTHER PUBLICATIONS mytenspeeds.com, "Handlebar Maintenance", www.mytenspeeds.com, copyright 2008 published Apr. 2010, pp. 1-6.*
(Continued)

*Primary Examiner* — Todd E Manahan
*Assistant Examiner* — Jennifer Gill
(74) *Attorney, Agent, or Firm* — Brian M. Dingman; Dingman IP Law, PC

(57) ABSTRACT

A headband that holds one or more earphones against the head of a wearer. The headband includes a slider that supports an earphone, a generally tubular cushion assembly that has an inside and an outside and that is engaged with the slider so as to allow relative movement of the slider and the cushion assembly, where the slider is located at least in part inside of the cushion assembly. A flexible cover is located over at least some of the outside of the cushion assembly, where the cover has an engaging portion that is located inside of the cushion assembly. A retaining member is located at least in part inside of the cushion assembly, where the engaging portion of the cover is located between the retaining member and the inside of the cushion assembly.

9 Claims, 4 Drawing Sheets

(56) References Cited

U.S. PATENT DOCUMENTS

| | | | | |
|---|---|---|---|---|
| 4,609,786 | A * | 9/1986 | Omoto et al. | 381/383 |
| 4,821,318 | A * | 4/1989 | Wu | 379/430 |
| 5,574,795 | A | 11/1996 | Seki | |
| 7,412,070 | B2 | 8/2008 | Kleinschmidt et al. | |
| 7,970,159 | B2 | 6/2011 | Kleinschmidt et al. | |
| 2003/0210801 | A1* | 11/2003 | Naksen et al. | 381/370 |
| 2009/0285435 | A1* | 11/2009 | Nelson et al. | 381/378 |
| 2010/0046782 | A1 | 2/2010 | Ito et al. | |
| 2013/0343591 | A1* | 12/2013 | Brunner et al. | 381/371 |
| 2014/0205129 | A1* | 7/2014 | Blair et al. | 381/378 |

OTHER PUBLICATIONS

The International Search Report and the Written Opinion of the International Searching Authority dated Sep. 18, 2015 (Sep. 18, 2015) in corresponding PCT Application No. PCT/US2015/022639.
Invitation to Pay Additional Fees and, Where Applicable, Protest Fee issued by the International Searching Authority dated Jun. 15, 2015 for corresponding PCT Application No. PCT/US2015/022639.
The International Preliminary Report on Patentability issued by the International Bureau on behalf of the International Searching Authority dated Sep. 27, 2016 for corresponding PCT Application No. PCT/US2015/022639.

* cited by examiner

HEADBAND

BACKGROUND

This disclosure relates to a headband that can be used to hold one or more earphones against the head of a wearer.

Headphones, headsets and the like carry earphones at the ends of a headband that fits over the head of the wearer. The central portion of the headband that fits over the crest of the head is often a cushioned flat elongated tubular portion that is called a "cushion" or "cushion assembly." The cushion assembly needs to flex so that it fits different sized and shaped heads. Flexing can cause folding or bunching of the soft cover of the cushion assembly; this detracts from its comfort and appearance.

SUMMARY

Folding and bunching of the soft cover of a headband cushion assembly can be lessened with a flexible cover that is able to stretch in two dimensions and is held in tension on the outside of the tubular cushion assembly. To present a clean appearance the cover can be folded into the ends of the cushion assembly and held in place with snap rings that fit into the ends of the tube and push the ends of the cover against the inside of the tube.

All examples and features mentioned below can be combined in any technically possible way.

In one aspect, a headband for holding one or more earphones against the head of a wearer includes a slider that supports an earphone, and a generally tubular cushion assembly that has an inside and an outside and that is engaged with the slider so as to allow relative movement of the slider and the cushion assembly, where the slider is located at least in part inside of the cushion assembly. There is a flexible cover that defines at least some of the outside of the cushion assembly, where the cover has an engaging portion that is located inside of the cushion assembly. A retaining member is located at least in part inside of the cushion assembly, where the engaging portion of the cover is located between the retaining member and the inside of the cushion assembly.

Embodiments may include one of the following features, or any combination thereof. The cushion assembly may have an end, and the cover may be located over at least some of the end of the cushion assembly. The retaining member may comprise a ring. The ring may comprise a face that is located just outside of the end of the cushion assembly. The cover may be located between the face of the ring and the end of the cushion assembly. The headband may further comprise mating engaging features in the ring and on the inside of the cushion assembly, where the features engage one another when the ring is seated in the cushion assembly. The mating engaging features may comprise a detent assembly. The detent assembly may comprise a plurality of projections that project inwardly from the inside of the cushion assembly and a plurality of openings in the ring that are each constructed and arranged to receive a projection.

Embodiments may include one of the above and/or below features, or any combination thereof. The engaging portion of the cover may be an end of the cover. The cover may be generally tubular such that it covers substantially the entire outside of most or all of the length of the cushion assembly. The headband may further comprise an adhesive between the engaging portion of the cover and the inside of the cushion assembly. The cushion assembly may have two opposed ends, and at least one of the ends may comprise a unitary annular portion or separate member. The cover may comprise a four-way stretch fabric. The cover may be held in tension on the cushion assembly.

In another aspect, a headband for holding earphones against the head of a wearer includes two sliders, where each slider supports an earphone, and a generally tubular cushion assembly that has an inside and an outside and two opposed ends, where the cushion assembly is engaged with the sliders so as to allow relative movement of the sliders and the cushion assembly. The sliders are located at least in part inside of the cushion assembly. There is a flexible cover comprising a four-way stretch fabric that is held in tension and defines at least a portion of the outside of the cushion assembly, where the cover has two ends that are each located inside of the cushion assembly. There are two retaining rings, where one retaining ring is located in part inside of the cushion assembly at one of its ends and the other retaining ring is located at least in part inside of the cushion assembly at the other of its ends, where the ends of the cover are each located between a retaining ring and the inside of the cushion assembly. There are mating engaging features in each ring and on the inside of the cushion assembly proximate each of its ends, where the features engage one another when the rings are seated in the cushion assembly.

Embodiments may include one of the above and/or below features, or any combination thereof. The mating engaging features may comprise a detent assembly that comprises a plurality of projections that project inwardly from the inside of the cushion assembly proximate each of its ends, and a plurality of openings in each ring that are each constructed and arranged to receive a projection. The cover may be generally tubular and cover substantially all of the outside of the cushion assembly. Each ring may comprise a face that is located just outside of an end of the cushion assembly. The headband may further comprise an adhesive between the ends of the cover and the inside of the cushion assembly. Each end of the cushion assembly may comprise a unitary annular member.

In another aspect, a headband for holding earphones against the head of a wearer includes two sliders, where each slider supports an earphone, and a generally tubular cushion assembly that has an inside and an outside and two opposed ends, wherein each end of the cushion assembly comprises a unitary annular member. The cushion assembly is engaged with the sliders so as to allow relative movement of the sliders and the cushion assembly. The sliders are located at least in part inside of the cushion assembly. There is a generally tubular flexible cover comprising a four-way stretch fabric that is held in tension and defines substantially all of the outside of the cushion assembly, where the cover has two ends that are each located inside of the cushion assembly. An adhesive is located between the ends of the cover and the inside of the cushion assembly. There are two retaining rings, where one retaining ring is located in part inside of the cushion assembly at one of its ends and the other retaining ring is located in part inside of the cushion assembly at the other of its ends, where the ends of the cover are each located between a retaining ring and the inside of the cushion assembly and wherein each ring comprises a face that is located just outside of the end of the cushion assembly. There is a detent assembly that comprises a plurality of projections that project inwardly from the inside of the cushion assembly proximate each of its ends and a plurality of openings in each ring that are each constructed and arranged to receive a projection.

DETAILED DESCRIPTION

The cover of the cushion assembly of a headband can be maintained such that it does not bunch or wrinkle as the headband is flexed by using a flexible cover that is held in tension using a retaining member that is inserted into the two open ends of the cushion assembly.

Figure 1:
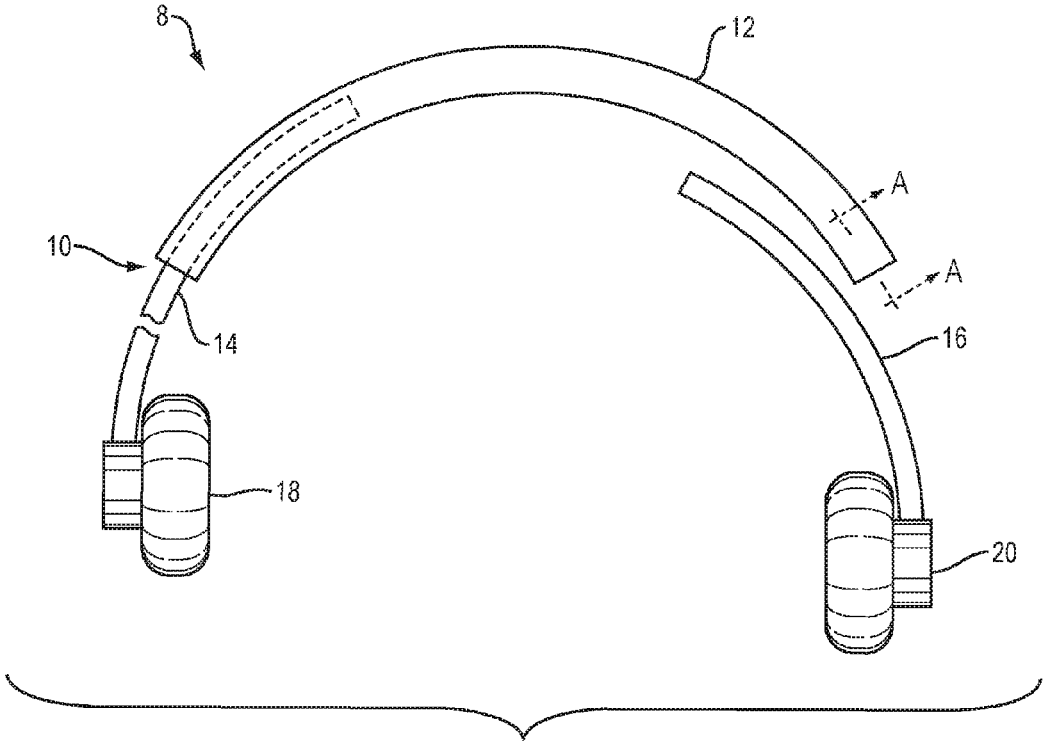
FIG. 1 shows headphones with the subject headband.

FIG. 1 shows headphones 8. Headphones 8 include headband 10 which includes cushion assembly 12 that is constructed and arranged to be placed over the crown of the head of a person. Sliders 14 and 16 support earphones 18 and 20. The sliders engage with cushion assembly 12 in a manner which allows the sliders to be moved in and out of the cushion assembly to adjust the overall length of the headband so that they headphones can sit comfortably on, in or over the ears of the wearer. This overall arrangement of headphones is known in the art. Also, in some cases a microphone (not shown) can be included so that the headphones can be used as a headset. Further, some headphones or headsets include only one earphone, in which case there may be only one slider.

Cushion assembly 12 is preferably generally tubular. This arrangement allows the sliders to be received within the volume on the inside of the tube and also allows wiring to pass along the length of the cushion assembly. Sliders 14 and 16 are located in part in this interior volume of the cushion assembly.

Cushion assembly 12 preferably comprises a structural tube 30 that is generally annular and can have a desired cross sectional shape, which in the non-limiting example shown in the drawings is generally rectangular or trapezoidal. However, the shape could be different such as more of a flat oval or the like. The shape is designed to sit comfortably on a head while also providing sufficient interior room and structure to couple with the sliders and allow the sliders to be moved in and out of structural tube 30. Structural tube 30 defines an interior 31. Tube 30 can be made of metal or plastic or other materials.

Flexible cover 32 is located over at least some of the outside of tube 30 such that the cover defines at least some the outside of the cushion assembly. Cover 32 preferably but not necessarily circumscribes tube 30 and preferably but not necessarily extends the entire length of tube 30. Cover 32 can in part function to cushion the bottom of the tube so that it is more comfortable when worn on the head. Cover 32 also has an aesthetic purpose in that it typically comprises part of or the entirety of the exterior of the cushion assembly that is seen by the wearer and others. Cover 32 needs to be flexible, in part because cushion assembly 12 must be able to flex (bend) along its longitudinal axis so that it can be flexed as it is placed over the head, and also so that it can fit different heads. In some cases the flexion also contributes to pushing the earphones against the head.

Figure 2:
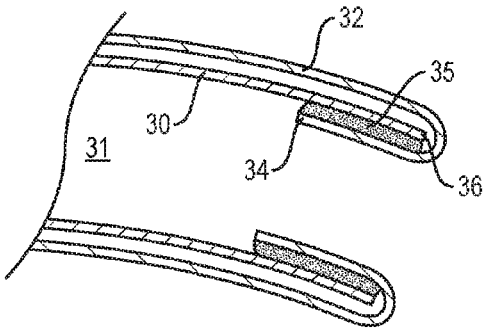
FIG. 2 is an enlarged partial cross-sectional view taken through section A-A of the cushion assembly of the headband of FIG. 1.

Cover 32 is preferably made at least in part from a fabric or another flexible substrate that stretches in four directions in the plane of the cover, sometimes called four-way stretch fabric. Materials such as neoprene or spandex have this property and can be used but these materials per se are not a limitation. In order for the cover to present a uniform appearance, it is desirable that the cover not fold or bunch as the cushion assembly is bent or twisted. In order to accomplish this objective, the cover should be stretched and held or retained in tension on tube 30. One manner in which a stretchable cover can be held in tension on tube 30 is as follows. Cover 32 can be created as a tube that can be slipped over tube 30. Cover 32 can be longer than tube 30 so that its ends can be folded over the ends of tube 30 and pushed inside of the tube. The ends need to be retained in place so that the cover is held on tube 30 but also is free to move relative to tube 30, while also being held in tension. This retention can be accomplished at least in part by including an adhesive 35 that is located between the interior ends of tube 30 and end 34 of cover 32. See FIG. 2. Since the adhesive holds the ends of the cover inside of structural tube 30, while the cover is not coupled or connected to the outside of tube 30, the cover is held relatively uniformly in tension and is free to float, or move slightly relative to the outer surface of tube 30. Since the cover can stretch in four directions, as the cushion assembly is flexed and twisted in use the cover remains in tension and thus is less likely to bunch or fold. A result is that the cover maintains a uniform appearance as the headphones are moved, flexed and used.

Figure 3:
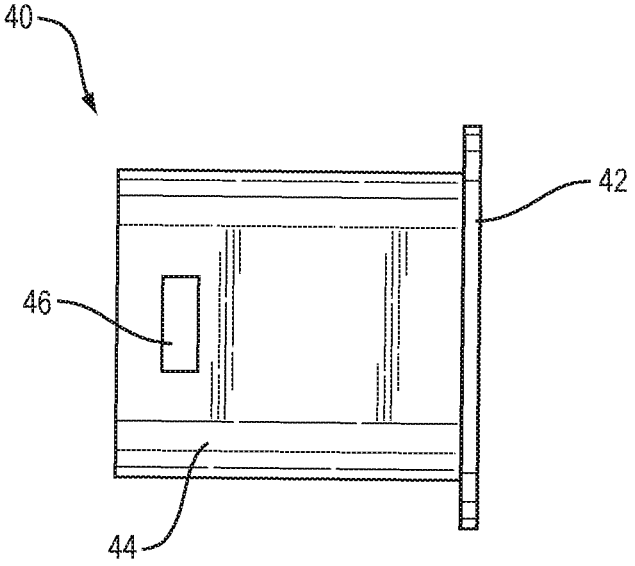
FIG. 3 is a side view of a retaining member of the headband.

End 34 of cover 32 extends over the annular face 36 of tube 30. Retaining member or snap ring 40, FIG. 3, may be used to help hold the end of the cover in place inside of tube 30 and also present a more finished appearance at the ends of cushion assembly 12. Retaining member 40 is a generally annular snap ring with an annular body 44 that is shaped and sized to closely fit in the inside of the ends of tube 30. Retaining member 40 also includes an enlarged annular face portion 42 that is sized and shaped to overlay face 36 as shown in FIGS. 4-6 and 8.

Retaining member 40 can be held in place in and against tube 30 by including mating engaging features in the retaining member and on the inside of the cushion assembly, where the features engage one another when ring 44 is properly seated inside of tube 30. These mating engaging features may comprise a detent assembly. The detent assembly may comprise a number of projections that project inwardly from the inside of tube 30 and a number of openings in ring 44 that are each constructed and arranged to receive one of the projections. Other known types of detent assemblies may alternatively be used.

Figure 4:
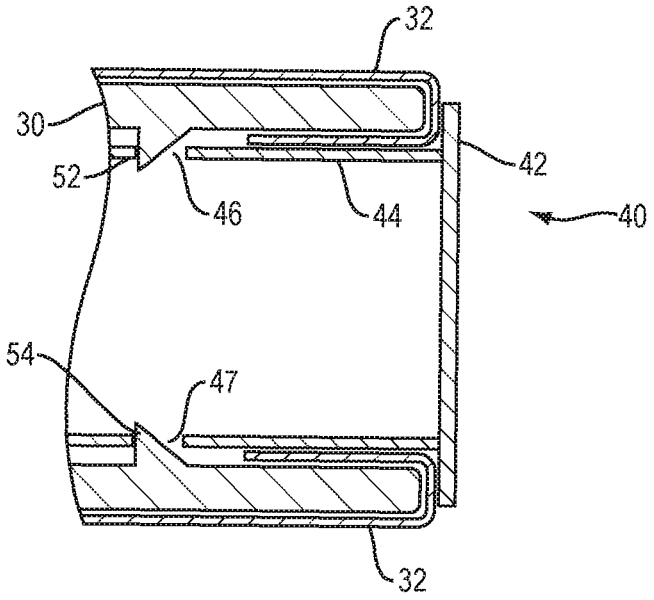
FIG. 4 is an enlarged cross-sectional view taken through section A-A of the cushion assembly of the headband of FIG. 1.
Figure 5:
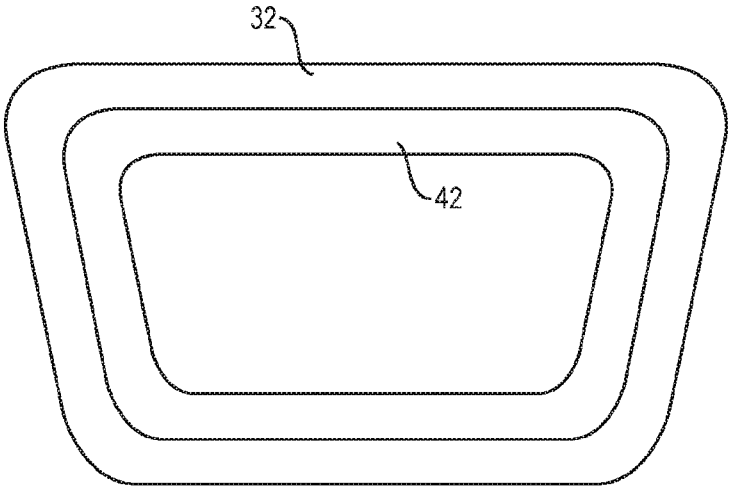
FIG. 5 is an end view of the cushion assembly.

In the non-limiting example shown in FIG. 4, tube 30 includes projections 52 and 54 while ring 44 includes two mating openings 46 and 47, FIG. 4. Opening 46 is shown in more detail in FIG. 3. Ring 44 can be made from a thin spring steel or the like such that it flexes sufficiently for the ring to be pushed over these projections until the projections pass through and seat in the openings in the ring. Face 42 of ring 44 overlies the face 36 of tube 30 as well as the part of the cover that overlies face 36. A result is that retaining member face 42 provides a more finished appearance of the two ends of the cushion assembly. See FIGS. 5 and 6.

Figure 6:
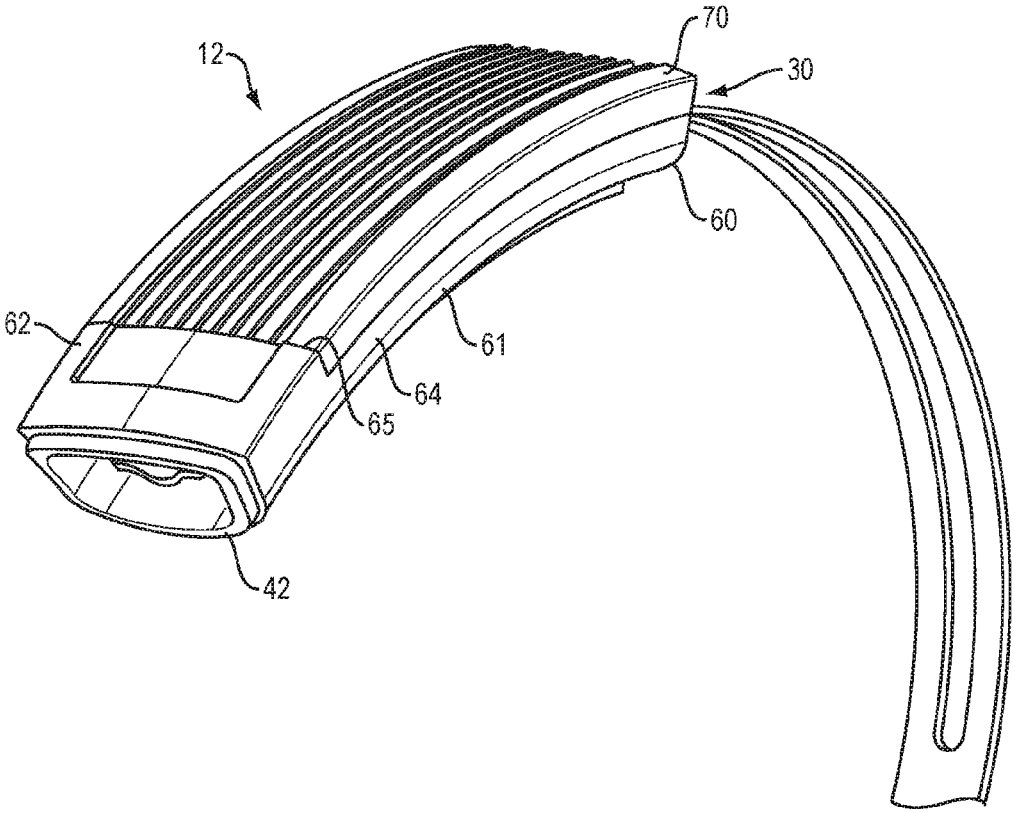
FIG. 6 is a perspective view of the cushion assembly.
Figure 7:
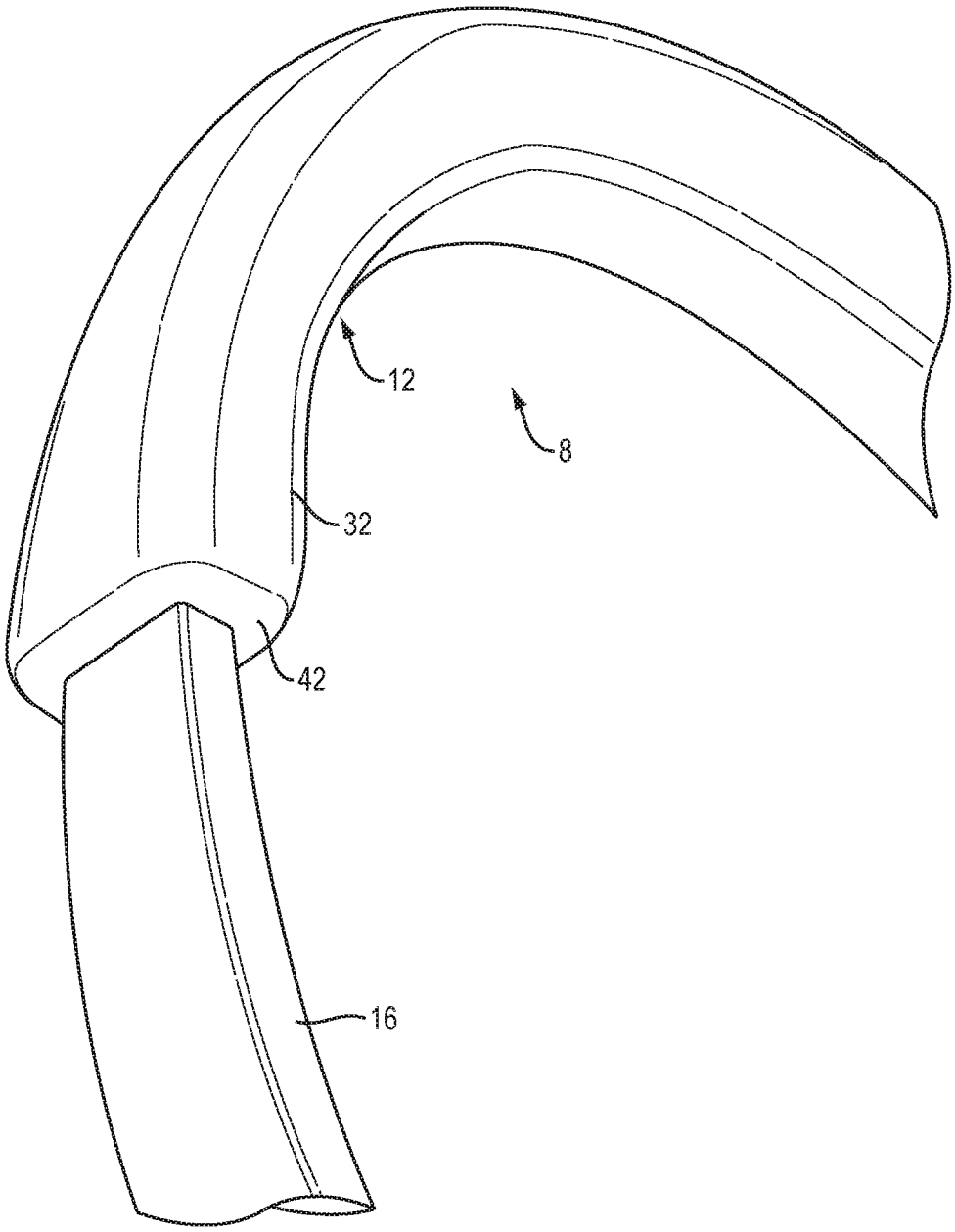
FIG. 7 is a perspective view of one end of the cushion assembly, and a slider engaged with the cushion assembly.

Tube 30 can be constructed in a desired fashion. For example it can be an extruded plastic or metal tube. Or it can be made in two parts, for example in a clamshell construction that results in longitudinal seams along two opposed sides of the tube. One issue with a clamshell construction is that the outward pressure applied by the snap rings will tend to push the two halves apart. The hoop strength of a tube constructed in this manner can be increased by including a unitary annular member or portion extending from one of the clamshell halves at one or both ends of the tube, as shown in FIGS. 6-7. Alternatively, a separate annular member may be located inside of or outside of the tube. Since these unitary end members do not include a longitudinal central seam that exists in a tube made by a clamshell technique, the end members will help resist the clamshell from being pushed apart.

One non-limiting example of the construction of cushion assembly 12 is shown in more detail in FIGS. 6-7. Cushion assembly 12 comprises structural tube 30 which is, generally, of a clamshell construction as described above. Tube 30 is made from bottom tube member 60 that is mechanically coupled to top tube member 70. Bottom tube member 60 includes integral hoop or annular member 62 which receives cover retaining member 40. Such a hoop may be located on both ends of tube 30, to support both retaining members. Longitudinal seam 64 where member 70 meets mating portion 61 of member 60 is shown in FIG. 6. Cover 32 is shown in FIG. 7 covering tube 30 and engaged behind face 42 of retaining member 40. Cover 32 is smooth in appearance without folds or creases. Slider 16 carries channel member 74 that rotatably carries the headphone yoke (not shown) which carries an earphone (not shown).

A number of implementations have been described. Nevertheless, it will be understood that additional modifications may be made without departing from the scope of the inventive concepts described herein, and, accordingly, other embodiments are within the scope of the following claims.

What is claimed is:

1. A headband for holding one or more earphones against a head of a wearer, comprising:

a slider that supports an earphone;

a generally tubular cushion assembly having an inside and an outside, the generally tubular cushion assembly constructed and arranged to flex in at least a longitudinal direction, the generally tubular cushion assembly comprising a structural tube having an inside, an outside, and an end, and a continuous tubular flexible cover for slipping over the structural tube, where the continuous tubular flexible cover is held in tension and defines at least some of the outside of the cushion assembly, where the continuous tubular flexible cover has an engaging portion that is located in the inside of the structural tube, wherein ends of the continuous tubular flexible cover are retained in place relative to the structural tube while the body of the continuous tubular flexible cover is free to move relative to the structural tube, and where the continuous tubular flexible cover is located over at least some of the end of the structural tube; and;

a ring located at least in part inside of the structural tube, where the engaging portion of the continuous tubular flexible cover is located between the ring and an interior surface of the structural tube the ring comprising a face that is located just outside of the end of the structural tube, wherein the continuous tubular flexible cover is located between the face of the ring and the end of the structural tube, and, wherein the cushion assembly is engaged with the slider so as to allow relative movement between the slider and the cushion assembly, where the slider is located at least in part inside of the cushion assembly.

2. The headband of claim 1 further comprising a plurality of projections that project inwardly from the inside of the structural tube and a plurality of openings in the retaining ring, where each of the plurality of openings is constructed and arranged to receive a projection of the plurality of projections.

3. The headband of claim 1 wherein the engaging portion of the continuous tubular flexible cover is an end of the continuous tubular flexible cover.

4. The headband of claim 1 wherein the continuous tubular flexible cover is covers the entire outside of the structural tube and defines the outside of the cushion assembly.

5. The headband of claim 1 wherein the continuous tubular flexible cover comprises a four-way stretch fabric.

6. A headband for holding earphones against a head of a wearer, comprising:

two sliders, where each slider supports an earphone;

a generally tubular cushion assembly having an inside and an outside, the generally tubular cushion assembly constructed and arranged to flex in at least a longitudinal direction, the generally tubular cushion assembly comprising a structural tube having an inside and an outside, and a continuous tubular flexible cover for slipping over the structural tube comprising a four-way stretchable fabric, the continuous tubular flexible cover wherein is held in tension and defines at least a portion of the outside of the cushion assembly, wherein the continuous tubular flexible cover has first and second engaging portions, where a first engaging portion is located inside a first end of the structural tube and a second engaging portion is located inside of a second, opposing end of the structural tube, wherein ends of the continuous tubular flexible cover are retained in place relative to the structural tube while the body of the continuous tubular flexible cover is free to move relative to the structural tube;

the generally tubular cushion assembly further comprising first and second retaining rings, where the first retaining ring is located at least in part inside of the first end of the structural tube and the second retaining ring is located at least in part inside of the second end of the structural tube, where the first engaging portion of the continuous tubular flexible cover is located between the first retaining ring and an interior surface of the first end of the structural tube and the second engaging portion of the continuous tubular flexible cover is located between the second retaining ring and an interior surface of the second end of the structural tube; and first and second pluralities of openings in the first and second retaining rings respectively and first and second pluralities of protrusions located on the interior surface of the structural tube proximate each of the first and second ends of the structural tube, wherein the first and second pluralities of openings of the retaining rings engage the first and second pluralities of protrusions of the structural tube in the respective end on the structural tube into which each retaining ring is seated;

wherein the cushion assembly is engaged with the sliders so as to allow relative movement between the sliders and the cushion assembly, where the sliders are located at least in part inside of the cushion assembly, wherein the sliders pass through the first and second ends of the structural tube in which the first and second retaining rings are located.

7. The headband of claim 6 wherein each of the openings of the first and second pluralities of openings is constructed and arranged to be capable of receiving a projection of the respective first and second plurality of projections.

8. The headband of claim 6 wherein each of the first and second retaining rings comprises a face that is located just outside of an end of the structural tube where the respective retaining ring is located, wherein each face overlies the respective end of the first and second ends of the structural tube.

9. A headband for holding earphones against a head of a wearer, comprising:

first and second sliders, where each of the first and second sliders supports an earphone;

a generally tubular cushion assembly having an inside and an outside and first and second ends, the generally tubular cushion assembly constructed and arranged to flex in at least a longitudinal direction, the generally tubular cushion assembly comprising a structural tube having first and second ends and a continuous tubular flexible cover comprising a four-way stretch fabric that is held in tension and fits around an exterior surface of the structural tube, where the continuous tubular flexible cover has first and second ends that are each located inside respective first and second ends of the structural tube, wherein the first and second ends of the continuous tubular flexible cover are retained in place relative to the structural tube while the body of the continuous tubular flexible cover is free to move relative to the structural tube;

wherein the cushion assembly further comprises first and second unitary annular members located at respective first and second ends of the cushion assembly, an adhesive located between the first and second ends of the continuous flexible cover and interior surfaces of the first and second ends of the structural tube; and wherein the cushion assembly is engaged with the first and second sliders so as to allow relative movement between the first and second sliders and the cushion assembly, where the first and second sliders are located at least in part inside of the cushion assembly, wherein the sliders pass through the first and second ends of the structural tube.

* * * * *